US007124815B2

(12) United States Patent
Rosine et al.

(10) Patent No.: US 7,124,815 B2
(45) Date of Patent: Oct. 24, 2006

(54) TUBING INJECTOR FOR VARIABLE DIAMETER TUBING

(75) Inventors: Randy S. Rosine, Duncan, OK (US); Gerald Kierbow, Duncan, OK (US); Jim Dines, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 11/132,040

(22) Filed: May 18, 2005

(65) Prior Publication Data

US 2006/0081368 A1 Apr. 20, 2006

Related U.S. Application Data

(63) Continuation-in-part of application No. 10/967,927, filed on Oct. 19, 2004.

(51) Int. Cl.
*E21B 19/22* (2006.01)

(52) U.S. Cl. ..... 166/77.3; 226/177; 91/48

(58) Field of Classification Search ..... 91/442, 91/286, 48, 47, 266, 46; 226/172, 177; 166/77.3
See application file for complete search history.

(56) References Cited

U.S. PATENT DOCUMENTS

| | | | | |
|---|---|---|---|---|
| 5,553,668 | A | 9/1996 | Council et al. | |
| 5,596,823 | A * | 1/1997 | Clasen et al. | 37/232 |
| 5,853,118 | A | 12/1998 | Avakov | |
| 6,209,634 | B1 * | 4/2001 | Avakov et al. | 166/77.3 |
| 6,367,557 | B1 | 4/2002 | Rosine et al. | |
| 2005/0247455 | A1 * | 11/2005 | Domann | 166/384 |

FOREIGN PATENT DOCUMENTS

GB 2387342 * 10/2003

* cited by examiner

*Primary Examiner*—William Neuder
*Assistant Examiner*—Nicole A Coy
(74) *Attorney, Agent, or Firm*—John W. Wustenberg; McAfee & Taft

(57) ABSTRACT

A tubing injector apparatus for use with variable diameter tubing. The apparatus comprises a pair of carriages which may be moved transversely and pivotally with respect to one another by actuating hydraulic actuator cylinders. A hydraulic control system uses relief valves to maintain a substantially constant pressure in the actuator cylinders when a tapered connector in the tubing passes between the carriages. A gripper chain in each carriage has gripper blocks to grippingly engage the tubing. A linear beam supports the gripper chain and has a plurality of resiliently biased segments therein to help maintain better contact with the tubing when the tapered connector passes through.

16 Claims, 5 Drawing Sheets

TUBING INJECTOR FOR VARIABLE DIAMETER TUBING

CROSS-REFERENCE TO RELATED APPLICATION

This application is a continuation-in-part of U.S. patent application Ser. No. 10/967,927 filed Oct. 19, 2004.

BACKGROUND

The present invention relates to tubing injectors for running tubing into a wellbore, and more particularly, to a tubing injector that provides a substantially constant pressure-clamping device engaging the tubing and in which the beam is preferably segmented.

After a well has been completed to produce oil and gas, it is necessary to periodically service the well. There are many occasions when the service procedure is carried out using coiled tubing. Such coiled tubing is inserted into the wellhead through a lubricator assembly or stuffing box. Typically, this is necessary because there is a pressure differential at the surface of the well and the atmosphere, which may have been naturally or artificially created, that serves to produce oil or gas or a mixture thereof from the pressurized well. The coiled tubing is inserted by an injector which generally incorporates a tubing guide, or gooseneck, and a plurality of gripper blocks for engaging the coiled tubing and moving it through the injector. One such injector apparatus is shown in U.S. Pat. No. 5,553,668 assigned to the assignee of the present invention.

The coiled tubing is relatively flexible and can therefore be cyclically coiled onto or off of a spool, or reel, by the injector, which often acts in concert with a windlass and a power supply, which drives the spool or reel. In the injector, the gripper blocks are attached to movable gripper chains. The gripper chains are movably mounted on linear beams, which provide support for the gripper blocks and gripper chains. The gripper blocks sequentially grip the coiled tubing that is positioned therebetween. When the gripper chains are in motion, each chain has a gripper block that is coming in contact with the coiled tubing as another gripper block on the same gripper chain is breaking contact with the coiled tubing. This continues in an endless fashion as the gripper chains are driven to force the coiled tubing into or out of the wellbore, depending on the direction in which the drive sprockets are rotated.

In the past, such coiled tubing has had a constant cross section. However, maintaining a constant diameter for the coiled tubing can present problems under certain circumstances. For example, it may be desirable to reduce the weight of the string, and this cannot be done if the string has a constant diameter. Further, a larger string causes more drag in the wellbore, particularly when the strings are being used in a horizontal or other deviated position of the well. To address this problem, a tubing string has been developed which has a tapered connection between two lengths of tubing having different diameters. This is accomplished by utilizing a tapered connector which provides an elongated tapering tubing string portion which is connected at opposite ends thereof to a larger tubing portion and a smaller tubing portion. This is shown in U.S. Pat. No. 6,367,557, also assigned to the assignee of the present invention.

As coiled tubing is used in deeper and higher pressure wells, there is a need to have a coiled tubing string that is optimized for weight and strength, and the coiled tubing strings with a variable outside diameter described above are now used. Handling the transition from smaller to larger coiled tubing with the tapered connector with current surface and wellhead equipment has created operational and safety challenges.

The beams in the injectors are pressure actuated by hydraulic cylinders. When a larger diameter portion of the coiled tubing is moved into the injector, the beams will be forced outwardly which applies force to the hydraulic cylinders. Because the hydraulic fluid in the hydraulic cylinders is virtually incompressible, the force on the hydraulic cylinders increases the pressure therein dramatically. This high pressure situation can either generate more force on the coiled tubing, causing it to be damaged, or subject the hydraulic cylinders to excessive pressure or both. Any of these results is obviously undesirable. Therefore, there is a need to control the pressure used to actuate the beams. The present invention solves this problem by providing a pressure control for the hydraulic cylinders, which actuates the beams so that the pressure stays the same for different sized coiled tubing portions.

Another problem with existing injectors is that they use flat one-piece beams, which are normally parallel. As a different outside diameter portion of coiled tubing enters the injector, the beams will start to open or close so that they are no longer parallel with each other. The result is that it is difficult, if even possible, to keep the chain system in contact with the coiled tubing. The present invention solves this problem by providing a segmented beam, which allows the gripper blocks to stay in contact with the coiled tubing even when a tapered connector is moving through the injector. Each segment or section of the beams is free to move, thus making up the difference in spacing caused by the tapered connector while also maintaining a substantially constant force on the coiled tubing and maintaining a maximum effective gripper length thereon.

SUMMARY

The present invention provides an improved injector apparatus for use in inserting coiled tubing into a wellbore, and is particularly adapted for use with coiled tubing strings having different sized coiled tubing therein.

The apparatus may be described as comprising a pair of carriages that are transversely and pivotally movable with respect to one another with the carriages being adapted for receiving a length of coiled tubing therebetween, a gripper chain on each of the carriages, a hydraulic actuator cylinder connected to the carriages for providing transverse movement thereof so that the gripper chains provide a lateral load on the coiled tubing and thus gripping engagement of the coiled tubing by the gripper chain, and a relief valve in communication with the hydraulic actuator cylinder to relieve pressure therein to prevent the lateral load from damaging the coiled tubing as the diameter of the coiled tubing increases. Preferably, the relief valve is a differential pressure relief valve.

In one embodiment, the hydraulic actuator cylinder is one of a plurality of hydraulic actuator cylinders comprising an upper cylinder and a lower cylinder. The relief valve is one of a plurality of relief valves comprising an upper relief valve in communication with the upper cylinder and a lower relief valve in communication with the lower cylinder. The upper and lower relief valves are adapted to maintain a substantially constant pressure in the upper and lower hydraulic actuator cylinders.

The apparatus further comprises a linear beam supporting the gripper chain. The linear beam defines a recess therein.

A plurality of resiliently biased beam segments are disposed in the recess. Preferably, a plurality of springs, hydraulic cylinders, or other force-providing elements are disposed in the recess, each acting as a means for biasing a corresponding segment toward the coiled tubing.

Stated in another way, the apparatus may be described as comprising a pair of carriages that are transversely and pivotally movable with respect to one another with the carriages being adapted for receiving a length of coiled tubing therebetween, a gripper chain on each of the carriages, a hydraulic actuator cylinder connected to the carriages for providing transverse movement thereof so that the gripper chains provide a lateral load on the coiled tubing and thus gripping engagement of the coiled tubing by the gripper chain, and a hydraulic control system connected to the hydraulic actuator cylinder and adapted for maintaining a substantially constant pressure in the hydraulic actuator cylinder regardless of the size of the coiled tubing.

Stated in still another way, the apparatus may be described as comprising a pair of carriages that are transversely and pivotally movable with respect to one another with the carriages being adapted for receiving a length of coiled tubing therebetween, a gripper chain on each of the carriages, and a linear beam supporting the gripper chain, the beam defining a recess therein and comprising a plurality of resiliently biased beam segments disposed in the recess.

Numerous objects and advantages of the invention will become apparent as the following detailed description of exemplary embodiments is read in conjunction with the drawings illustrating these embodiments.

BRIEF DESCRIPTION OF THE DRAWINGS

FIG. 6 is a schematic of a hydraulic control system of the invention.

DETAILED DESCRIPTION

Figure 1:
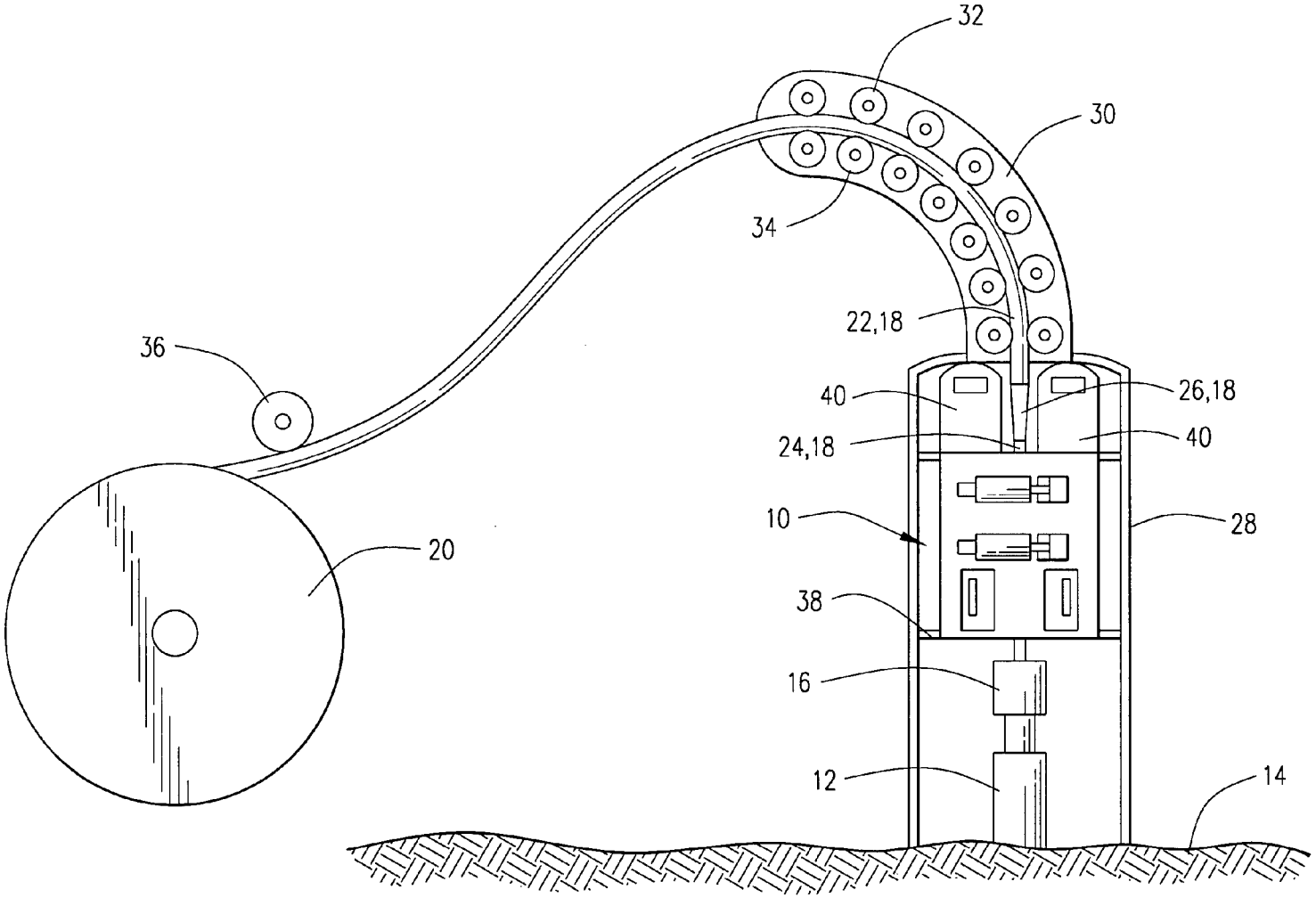
FIG. 1 schematically shows a tubing injector for variable diameter tubing of the present invention in position adjacent to a wellhead.

Referring now to the drawings, and more particularly to FIG. 1, a coiled tubing injector apparatus for variable outside diameter tubing of the present invention is shown and generally designated by the numeral 10. Injector 10 is shown positioned above a wellhead 12 of a well at a ground surface or subsea floor 14. A lubricator or stuffing box 16 is connected to the upper end of wellhead 12.

Tubing 18 is supplied on a long drum or reel 20 and is typically several thousand feet in length. Tubing 18 of sufficient length, such as 10,000 feet or greater, may be inserted into the well either as single tubing, or as tubing spliced by connectors or by welding. The outer diameters of the tubing 18 may vary, and the injector 10 is specifically designed to accommodate tubing 18 having a variable outside diameter with different sections of tubing 18 interconnected by tapered connectors. For example, tubing 18 can have a larger diameter portion 22 and a smaller diameter portion 24 interconnected by a tapered connector 26.

Typically, tubing 18 is in a relaxed but coiled state when supplied from drum 20. Tubing 18 is spooled from drum 20 and typically supported on a truck (not shown) for mobile operations where appropriate.

Injector 10 is mounted above wellhead 12 on a superstructure 28. Extending upwardly from superstructure 28 is a guide framework 30 having a plurality of pairs of guide rollers 32 and 34 rotatably mounted thereon.

Tubing 18 is supplied from drum 20 and is run between guide rollers 32 and 34. The amount of tubing 18 passing through injector 10 is measured in a manner known in the art, such as using a measuring wheel 36.

Guide rollers 32 and 34 define a pathway for tubing 18 so that the curvature in the tubing 18 is slowly straightened as it enters injector 10. As will be understood, tubing 18 is preferably formed of a material that is sufficiently flexible and ductile that it can be curved for storage on drum 20 and also later straightened. While the material is flexible and ductile and will accept bending around a radius of curvature, it runs the risk of being pinched or suffering from premature fatigue failure should the curvature be severe. Guide rollers 32 and 34 are spaced such that straightening of the tubing 18 is accomplished wherein the tubing 18 is inserted into the well without kinks or undue bending on the tubing 18.

Many of the main components in injector 10 are the same as those disclosed in U.S. Pat. No. 6,209,634 to Avakov, et al., assigned to the assignee of the present invention.

Referring now also to FIGS. 2–6, the details of injector 10 will be discussed. Injector 10 generally comprises a base 38 and a pair of substantially similar carriages 40 extending upwardly therefrom. Each carriage 40 includes a pair of spaced outer plates and a back plate. Each carriage 40 has a carriage lug 42 extending downwardly from a lower end thereof. The carriage lugs 42 mate with a pair of attachment lugs 44 which extend upwardly from base 38. A load pin 46 extends through each carriage lug 42 and the corresponding attachment lug 44, so that the carriages 40 are pivotally attached to base 38. Injector 10 also includes an actuating device 48 for moving carriages 40 laterally with respect to one another and with respect to base 38. Injector 10 has a front, or forward side 50, and a back, or rear side 52.

Figure 2:
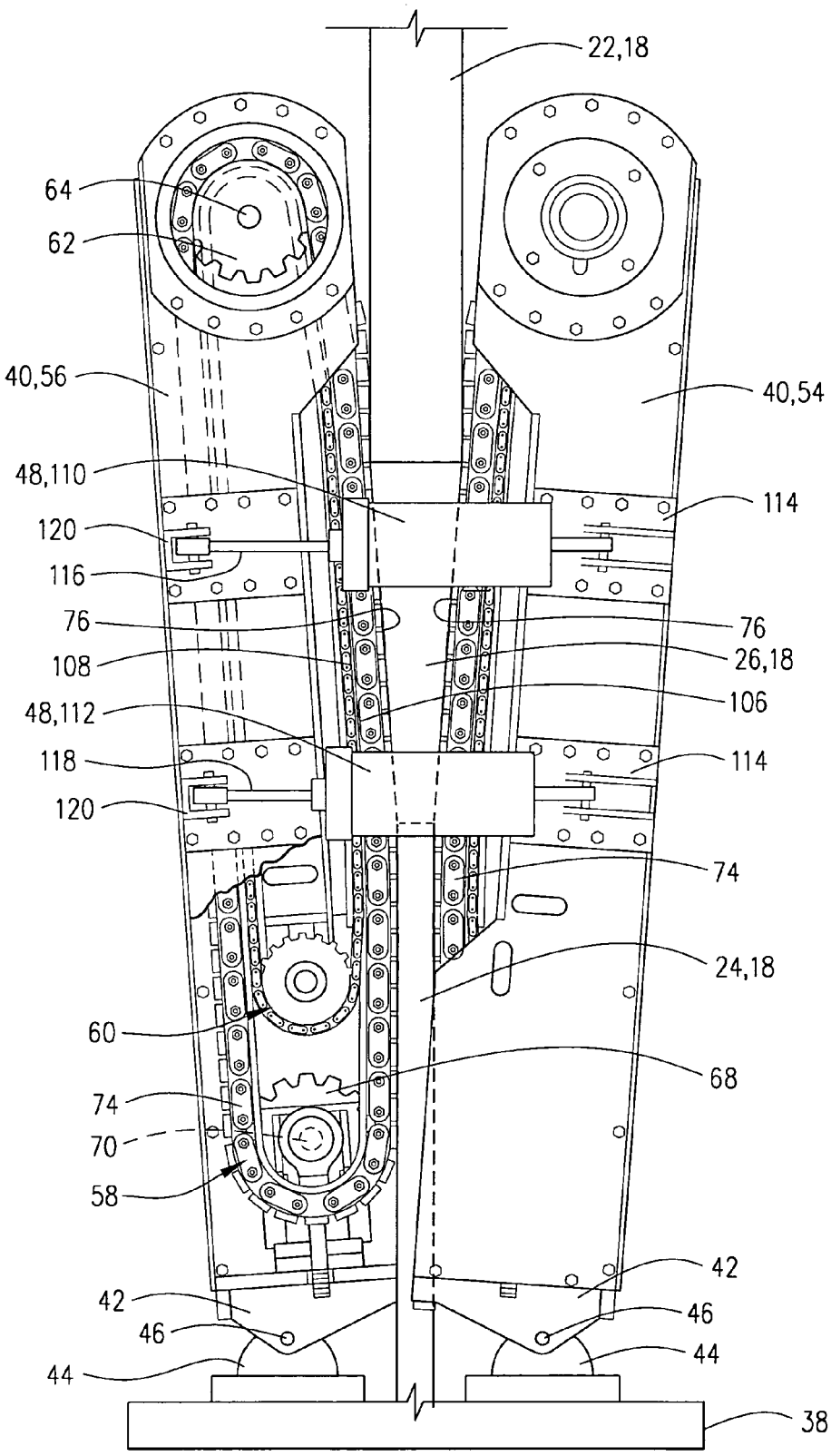
FIG. 2 shows a partial front elevation view and a partial cross section of the apparatus with a tapered tubing portion passing through it.

Spaced carriages 40 are comprised of first or right side carriage 54 and a second or left side carriage 56. Carriages 54 and 56 will slide towards and away from each other when actuating device 48 is actuated. They can also tilt or pivot with respect to one another to accommodate tapered connector 26 in tubing 18, as seen in FIG. 2. The carriages 54 and 56 are substantially similar in that they are mirror images of one another, as best seen in FIG. 2.

Figure 3:
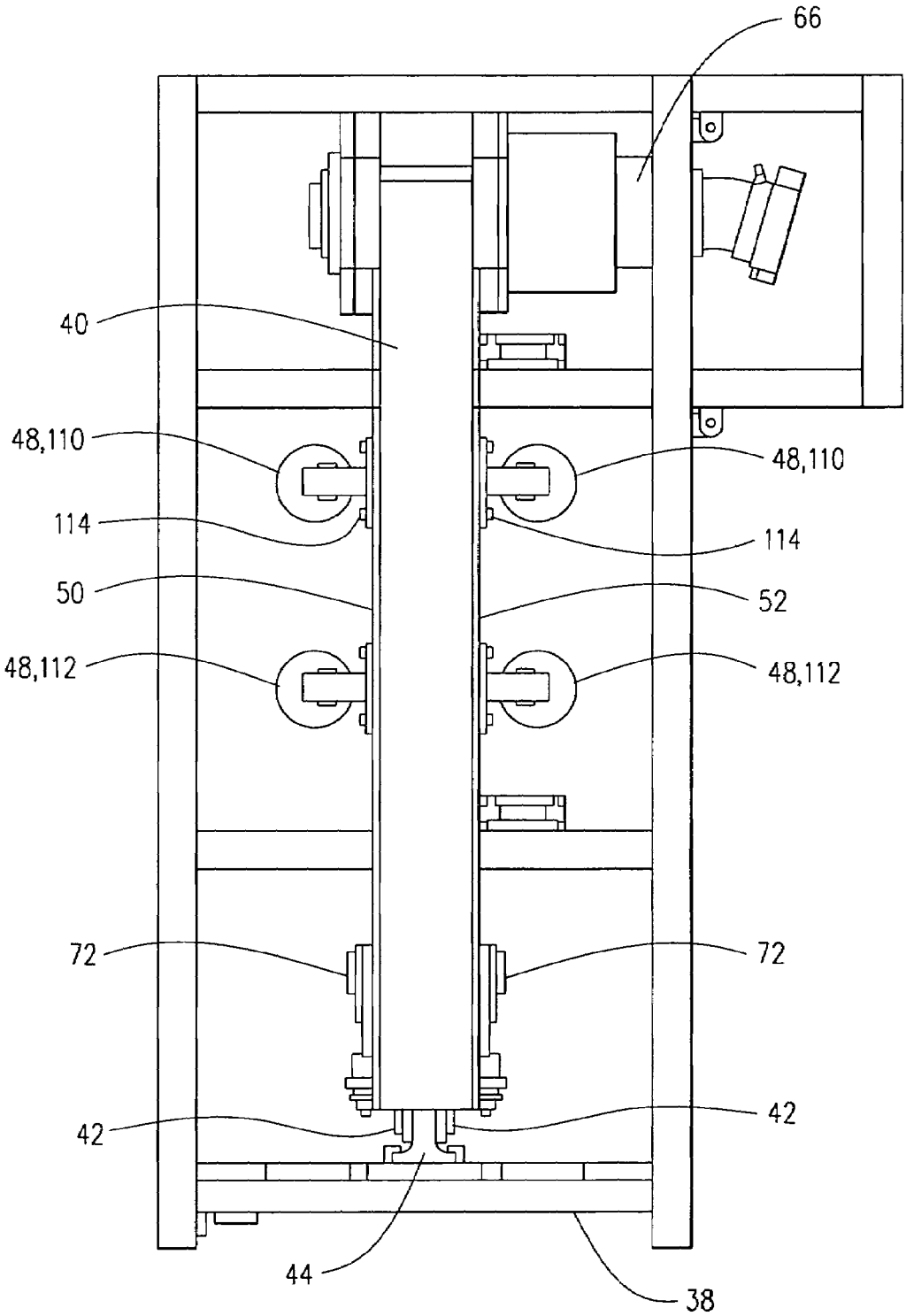
FIG. 3 is a side view of the apparatus.

Each carriage 40 also includes a gripper chain drive system 58 and a roller chain drive system 60. Gripper chain drive system 58 includes a pair of spaced gripper chain drive sprockets 62 rotatably disposed in the carriage 40. Gripper chain drive sprockets 62 are mounted on a shaft 64. Gripper chain drive sprockets 62 are driven by a reversible hydraulic motor 66 attached to each carriage 40, as seen in FIG. 3. Hydraulic motor 66 is of a type known in the art and is driven by a planetary gear and has an integral brake. Thus, hydraulic motor 66 can inject, retract or suspend tubing 18 in the well.

Gripper chain drive system 58 also includes a pair of spaced gripper chain idler sprockets 68 which are rotatably disposed in the lower end of each carriage 40. Gripper chain idler sprockets 68 are mounted on a shaft 70. Tensioners 72 are mounted on each carriage 40 so that the tensioners 72 can be vertically adjusted to keep the desired tension in a gripper chain 74 that is engaged with gripper chain drive sprockets 62 and gripper chain idler sprockets 68 in each carriage 40. Gripper chain 74 is of a kind known in the art and has a plurality of outwardly facing gripper blocks 76 disposed thereon, as seen in FIG. 2.

Gripper blocks 76 are adapted for engaging tubing 18 and moving it through injector 10. When actuating device 48 is actuated to move carriages 40 together, a lateral gripping force is applied to tubing 18 by gripper blocks 76. As will be further discussed herein, special problems arise when tubing 18 has a variable outside diameter.

Figure 4:
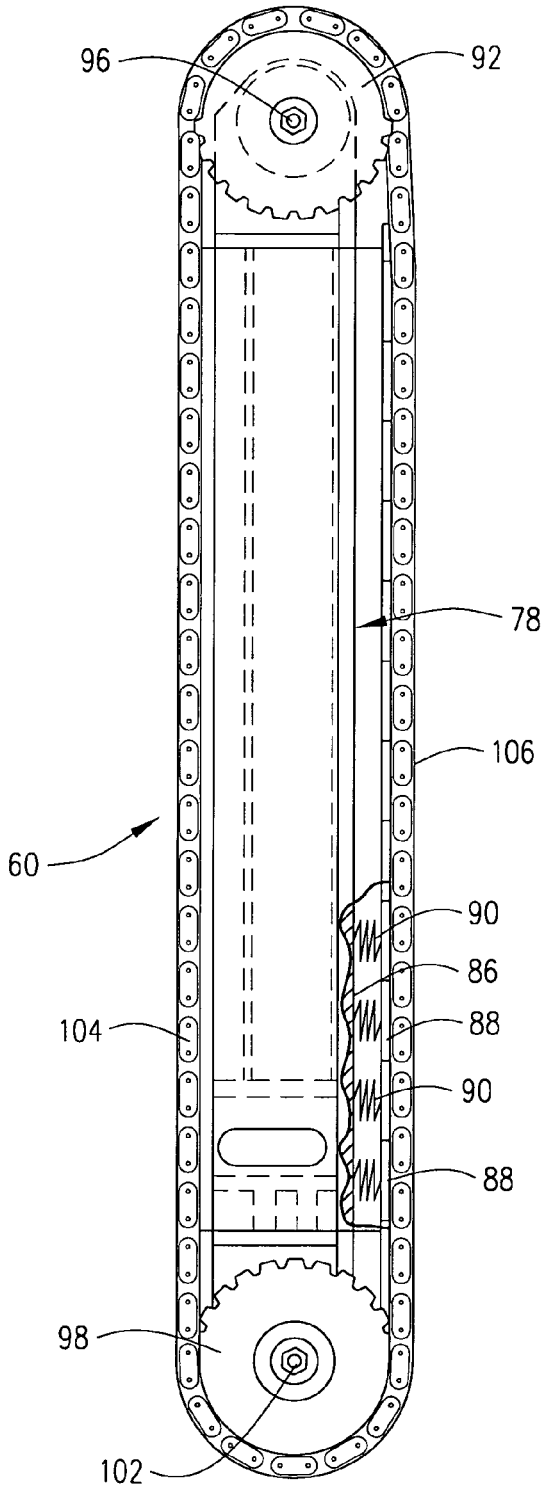
FIG. 4 is a partial elevation and partial cross section from the side of a segmented linear beam in the apparatus.
Figure 5:
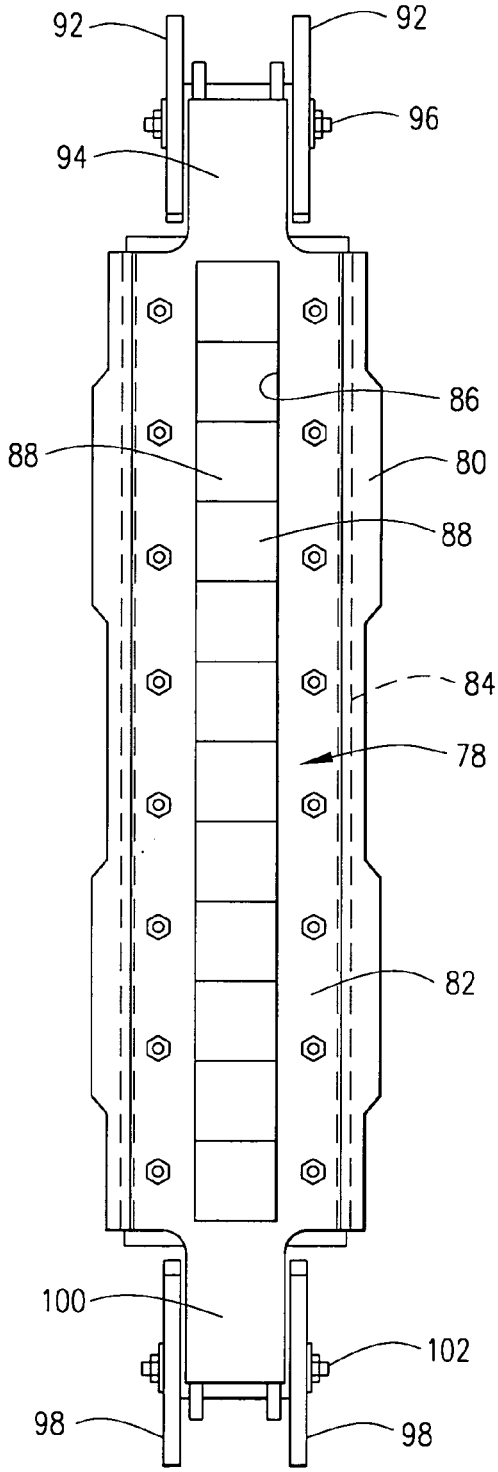
FIG. 5 shows the working face of the segmented linear beam with a roller chain removed.
Figure 5:
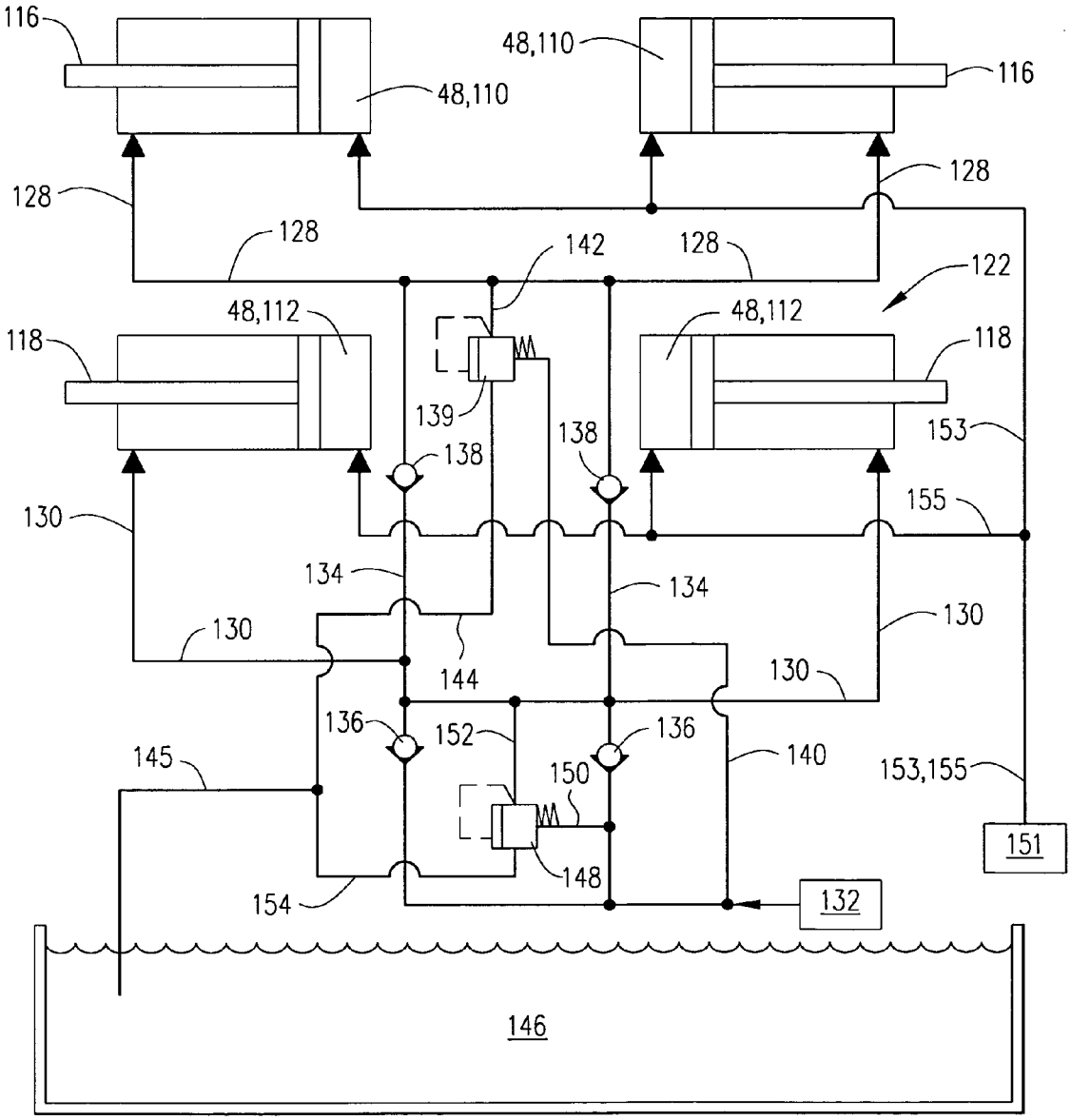

Referring to FIGS. 4 and 5, roller chain drive system 60 is rigidly positioned in each carriage 40 and includes a linear or pressure beam 78 attached to the carriages 40. Linear beam 78 comprises a linear beam frame 80 and a bearing plate 82 attached thereto. Linear beam frame 80 has side webs 84. Each linear beam 78 has a recess 86 defined therein. A plurality of beam segments 88 are disposed in recess 86 and are biased outwardly by a corresponding plurality of springs 90. As will be further discussed herein, these outwardly biased beam segments 88 can move independently from one another to accommodate engagement by varying diameters of tubing 18 and any tapered connectors 26 between the different diameters.

While spring biased beam segments 88 are disclosed herein, the invention is not intended to be limited to this particular configuration. Any means of adjusting the engagement of linear beam 78 with variable outside diameter tubing 18 will also work. For example, but not by way of limitation, rather than using spring biased beam segments 88, an elastomeric pad or similar structure could be positioned in recess 86.

Roller chain drive system 60 further comprises a pair of spaced, upper roller chain sprockets 92 connected to upper end 94 of linear beam 78 on a shaft 96, and a pair of spaced, lower roller chain sprockets 98 are connected to lower end 100 of linear beam 78 on a shaft 102. A roller chain 104 engages each pair of upper and lower roller chain sprockets 92 and 98. An outer side 106 of roller chain 104 is engaged with an inner side 108 of gripper chain 74 so that roller chain 104 moves with gripper chain 74. A tensioner (not shown) of a kind known in the art keeps the desired tension on roller chain 104.

Actuating device 48 comprises a pair of upper hydraulic actuator cylinders 110 and a pair of lower hydraulic actuator cylinders 112. Upper and lower hydraulic actuator cylinders 110 and 112 are attached to right side carriage 54 by mounting brackets 114. Upper and lower cylinder rods 116 and 118 of upper and lower hydraulic actuator cylinders 110 and 112, respectively, are attached to left side carriage 56 by mounting brackets 120.

A schematic of a hydraulic control system 122 for actuating device 48 is shown in FIG. 6. Hydraulic control system 122 is connected to upper and lower hydraulic actuator cylinders 110 and 112 on upper and lower cylinder rods 116 and 118 thereof by lines 128 and 130, respectively. Lines 128 are connected to a pressure source 132 of a kind known in the art by lines 134. Lines 130 are also connected to pressure source 132 by lines 134. Lines 134 have check valves 136 therein between lines 130 and pressure source 132 and check valves 138 between lines 130 and 128. Check valves 136 and 138 will be seen to allow flow from pressure source 132 to upper and lower hydraulic actuator cylinders 110 and 112 while preventing flow in the opposite direction.

One side of an upper differential pressure relief valve 139 is connected to pressure source 132 by a line 140, and the other side of upper differential pressure relief valve 139 is connected to line 128 by a line 142. Upper differential pressure relief valve 139 is designed to open when the pressure in line 142 exceeds the pressure in line 140 by a predetermined amount. In an exemplary embodiment, this pressure differential is in the range of approximately 10 to 50 psi, but the invention is not intended to be limited to any particular value. When upper differential pressure relief valve 139 opens in this manner it is vented through drain lines 144 and 145 to a vent tank 146.

One side of a lower differential pressure relief valve 148 is connected to line 134, and thus to pressure source 132, by a line 150, and the other side of lower differential pressure relief valve 148 is connected to line 130 by a line 152. Lower differential pressure relief valve 148 is also designed to open when the pressure in line 152 exceeds the pressure in line 150 by a predetermined amount. In an exemplary embodiment, this pressure differential is in the range of approximately 10 to 50 psi, but the invention is not intended to be limited to any particular value. When lower differential pressure relief valve 148 opens in this manner it is vented through drain lines 154 and 145 to vent tank 146.

Pressure is used to return upper and lower hydraulic actuator cylinders 110 and 112 to their unactuated positions. The side of upper hydraulic actuator cylinder 110 opposite upper cylinder rod 116 is connected to a second pressure source 151 by a line 153, and the side of lower hydraulic actuator cylinder 112 opposite lower cylinder rod 118 is connected to second pressure source 151 by another line 155. By applying the pressure from second pressure source 151, it will be seen that upper and lower cylinder rods 116 and 118 will be actuated by second pressure source 151 in the opposite direction from first-mentioned pressure source 132.

Operation

In operation, when it is desired that tubing 18 be lowered, raised or suspended in the well, actuating device 48 will be actuated by applying pressure to upper and lower hydraulic actuator cylinders 110 and 112 such that carriages 40 are moved together in a manner known in the art. This causes gripper blocks 76 on gripper chain 74 to engage tubing 18, applying a lateral load thereto. Thus, gripper blocks 76 on gripper chains 74 will first contact tubing 18 thereof adjacent to upper end 94 of linear beam 78, and the contact between tubing 18 and gripper blocks 76 will break at a point adjacent to lower end 100 of linear beam 78.

As shown in FIG. 2, when a portion of tubing 18 having tapered connector 26 enters injector 10, the lateral loading is forced out of balance. That is, the change in diameter of tubing 18 forces the upper portions of right and left side carriages 54 and 56 to move further apart than the lower portions thereof. This causes upper cylinder rods 116 in upper hydraulic actuator cylinders 110 to be further extended than lower cylinder rods 118 in lower hydraulic actuator cylinders 112. Because the hydraulic fluid in the upper and lower hydraulic actuator cylinders 110 and 112 is substantially incompressible, in prior art injectors this greatly increased the pressure in the system, which could easily cause tapered connector 26 and larger diameter portion 22 of tubing 18 to be damaged. In the present invention, upper differential pressure relief valve 139 in hydraulic control system 122 relieves the pressure in upper hydraulic actuator cylinders 110, thereby allowing upper cylinder rods 116 therein to be extended as tapered connector 26 passes therethrough so that the lateral pressure thereon is not increased. Similarly, lower differential pressure relief valve 148 relieves the pressure in lower hydraulic actuator cylinders 112 to allow lower cylinder rods 118 therein to extend without increasing the lateral load on tapered connector 26 and larger diameter portion 22 of tubing 18 as they pass through the lower portion of injector 10. That is, the pressure is maintained at a substantially constant level.

Also, because linear beam 78 has resiliently biased beam segments 88 therein, more of these beam segments 88 remain in contact with tubing 18 as tapered connector 26 passes through injector 10. Beam segments 88 help make up the change in distance caused by tapered connector 26 and thus assist in maintaining a substantially constant force on tubing 18 and further to maintain a maximum effective length of gripping contact on tubing 18.

It will be seen, therefore, that the injector 10 for variable diameter tubing 18 of the present invention is well adapted to carry out the ends and advantages mentioned as well as those inherent therein. While an exemplary embodiment of the invention has been shown for the purposes of this disclosure, numerous changes in the arrangement and construction of parts may be made by those skilled in the art. All such changes are encompassed within the scope and spirit of the appended claims.

What is claimed is:

1. A tubing injector apparatus comprising:

a pair of carriages that are transversely and pivotally movable with respect to one another, wherein the carriages are adapted for receiving a length of tubing therebetween;

a gripper chain on each of the carriages;

a linear beam supporting one of the gripper chains, the linear beam defining a recess therein;

a plurality of resiliently biased beam segments disposed in the recess;

a hydraulic actuator cylinder connected to the carriages for providing transverse movement thereof so that the gripper chains provide a lateral load on the tubing and thus gripping engagement of the tubing by the gripper chains; and a relief valve in communication with the hydraulic actuator cylinder to relieve pressure therein to prevent the lateral load from damaging the tubing as the diameter of the tubing increases.

2. The apparatus of claim 1 wherein the relief valve is a differential pressure relief valve.

3. The apparatus of claim 1 wherein:

the hydraulic actuator cylinder is one of a plurality of hydraulic actuator cylinders comprising:

an upper hydraulic actuator cylinder; and a lower hydraulic actuator cylinder; and the relief valve is one of a plurality of relief valves comprising:

an upper relief valve in communication with the upper hydraulic actuator cylinder; and a lower relief valve in communication with the lower hydraulic actuator cylinder.

4. The apparatus of claim 3 wherein the upper and lower relief valves are differential pressure relief valves.

5. The apparatus of claim 3 wherein the upper and lower relief valves are adapted to maintain a substantially constant pressure in the upper and lower hydraulic actuator cylinders.

6. The apparatus of claim 1 further comprising a plurality of springs disposed in the recess, wherein each spring is adapted for biasing a corresponding beam segment toward the tubing.

7. A tubing injector apparatus comprising:

a pair of carriages that are transversely and pivotally movable with respect to one another, wherein the carriages are adapted for receiving a length of tubing therebetween;

a gripper chain on each of the carriages;

a linear beam supporting one of the gripper chains, wherein the linear beam defines a recess therein; and a plurality of resiliently biased beam segments disposed in the recess.

8. The apparatus of claim 7 further comprising a plurality of springs disposed in the recess, wherein each spring is adapted for biasing a corresponding beam segment toward the tubing.

9. The apparatus of claim 8 further comprising a hydraulic actuator cylinder connected to the carriages for providing transverse movement thereof so that the gripper chains provide a lateral load on the tubing and thus gripping engagement of the tubing by the gripper chains.

10. The apparatus of claim 9 further comprising a relief valve in communication with the hydraulic actuator cylinder to relieve pressure therein to prevent the lateral load from damaging the tubing as the diameter of the tubing increases.

11. The apparatus of claim 10, wherein:

the hydraulic actuator cylinder is one of a plurality of hydraulic actuator cylinders comprising:

an upper hydraulic actuator cylinder; and a lower hydraulic actuator cylinder; and the relief valve is one of a plurality of relief valves comprising:

an upper relief valve in communication with the upper hydraulic actuator cylinder; and a lower relief valve in communication with the lower hydraulic actuator cylinder.

12. The apparatus of claim 11 wherein the upper and lower relief valves are adapted to maintain a substantially constant pressure in the upper and lower hydraulic actuator cylinders.

13. A tubing injector apparatus comprising:

a pair of carriages that are transversely and pivotally movable with respect to one another, wherein the carriages are adapted for receiving a length of tubing therebetween;

a gripper chain on each of the carriages;

a linear beam defining a recess therein supporting one of the gripper chains;

a plurality of resiliently biased beam segments disposed in the recess;

a hydraulic actuator cylinder connected to the carriages for providing transverse movement thereof so that the gripper chains provide a lateral load on the tubing and thus gripping engagement of the tubing by the gripper chains; and a hydraulic control system connected to the hydraulic actuator cylinder, wherein the hydraulic control system is adapted for maintaining a substantially constant pressure in the hydraulic actuator cylinder.

14. The apparatus of claim 13 wherein the hydraulic control system comprises a relief valve to relieve pressure in the hydraulic actuator cylinder to prevent the lateral load from damaging the tubing as the diameter of the tubing increases.

15. The apparatus of claim 14 wherein the relief valve is a differential pressure relief valve.

16. The apparatus of claim 13 further comprising a plurality of springs disposed in the recess, wherein each spring is adapted for biasing a corresponding beam segment toward the tubing.

* * * * *